US006868923B2

(12) United States Patent
Mitchell

(10) Patent No.: US 6,868,923 B2
(45) Date of Patent: Mar. 22, 2005

(54) PORTABLE APPARATUS AND METHOD FOR ASSISTING IN THE REMOVAL AND EMPLACEMENT OF PIPE STRINGS IN BOREHOLES

(75) Inventor: Brian R. Mitchell, Livermore, CA (US)

(73) Assignee: The Regents of the University of California, Oakland, CA (US)

( * ) Notice: Subject to any disclaimer, the term of this patent is extended or adjusted under 35 U.S.C. 154(b) by 110 days.

(21) Appl. No.: 10/233,227

(22) Filed: Aug. 30, 2002

(65) Prior Publication Data

US 2004/0040720 A1 Mar. 4, 2004

(51) Int. Cl.[7] ..... E21B 19/00
(52) U.S. Cl. ..... 175/203; 173/184; 166/77.51
(58) Field of Search ..... 175/203, 202, 175/122; 173/184, 186, 24, 30, 37, 39; 166/338, 340, 342, 348, 378, 380, 77.51, 77.52, 85.1

(56) References Cited

U.S. PATENT DOCUMENTS 3,773,188 A * 11/1973 Arrington ..... 414/744.8
3,774,780 A 11/1973 Buffington
3,913,754 A * 10/1975 Swartz et al. ..... 414/22.66
4,126,348 A 11/1978 Palmer
4,455,116 A * 6/1984 Lindstedt et al. ..... 414/22.66
4,552,498 A 11/1985 Dysarz
4,901,805 A 2/1990 Ali-Zade
5,174,389 A * 12/1992 Hansen ..... 175/52
5,226,488 A * 7/1993 Lessard et al. ..... 175/61
5,730,345 A 3/1998 Yeckley
6,227,587 B1 5/2001 Terral
6,536,520 B1 * 3/2003 Snider et al. ..... 166/78.1
6,681,470 B1 * 1/2004 Scott ..... 29/434

* cited by examiner

*Primary Examiner*—Frank Tsay
(74) *Attorney, Agent, or Firm*—James S. Tak; Alan H. Thompson; Eddie E. Scott

(57) ABSTRACT

A portable pipe installation/removal support apparatus for assisting in the installation/removal of a series of connectable pipe strings from a ground-level borehole. The support apparatus has a base, an upright extending from the base, and, in an exemplary embodiment, a pair of catch arms extending from the upright to define a catch platform. The pair of catch arms serves to hold an upper connector end of a pipe string at an operator-convenient standing elevation by releasably catching an underside of a pipe coupler connecting two pipe strings of the series of connectable pipe strings. This enables an operator to stand upright while coupling/uncoupling the series of connectable pipe strings during the installation/removal thereof from the ground-level borehole. Additionally, a process for installing and a process for removing a series of connectable pipe strings is disclosed utilizing such a support apparatus.

14 Claims, 4 Drawing Sheets

PORTABLE APPARATUS AND METHOD FOR ASSISTING IN THE REMOVAL AND EMPLACEMENT OF PIPE STRINGS IN BOREHOLES

The United States Government has rights in this invention pursuant to Contract No. W-7405-ENG-48 between the United States Department of Energy and the University of California for the operation of Lawrence Livermore National Laboratory.

FIELD OF THE INVENTION

The present invention relates to pipe laying methods and systems. More particularly the present invention relates to a portable pipe installation/removal apparatus and method for assisting in the installation and/or removal of a series of connectable pipes from a ground-level borehole, by enabling an operator to perform manual coupling/uncoupling of connectable pipes without having to repeatedly stoop over or bend down in the process.

BACKGROUND OF THE INVENTION

Groundwater well operations often require the deployment or retrieval of pipe strings, such as for submersible groundwater pumps. Many of these wells are located in "Christy boxes" which are surface mounted mechanical vaults. The conventional practice for these operations requires bending over repeatedly into such vaults, often as many as thirty times for one deployment or retrieval operation. This can be seen in FIG. 1 illustrating, for example, a conventional pump retrieval operation. For such operations, a truck mounted derrick rig 100 having a crane 101, winch 103, and winch cable 102 is typically used. This operation involves hooking an end of the cable to the top length of a pipe string 104. Once installed, the truck-mounted winch 103 is utilized to pull up the first length of pipe 104. Then, the operator 106 typically bends down to the ground and installs a spacer 108 beneath a pipe coupler 105 between the first 104 and second 107 pipe strings, in order to prevent the pump from falling back down into the well. Additionally, the operator 103, while remaining at ground level, must uncouple the first length of pipe from the pipe coupler, and couple the cable to the top of the next length of pipe. This process is continued until all pipe sections are removed and the pump is pulled out of the well, which can be hundreds of feet deep.

A common safety hazard associated with such groundwater pump deployment and retrieval operations is the back strain, pain, and other injuries incurred by operators due to the daily repetitive motion of bending/stooping, pulling and twisting involved during well testing and other well-related operations. For employers, this safety hazard often translates to expensive costs in terms of workers compensation claims. Additionally, such an operation typically requires two handlers/operators to complete a job, resulting in increased man-hours and labor costs.

SUMMARY OF THE INVENTION

One aspect of the present invention includes a portable pipe installation/removal support apparatus comprising: a base; an upright extending from the base; and means connected to the upright for releasably holding an upper connector end of a pipe string at an operator-convenient standing elevation to allow the operator to stand upright while coupling/uncoupling a series of connectable pipe strings during the installation/removal thereof from a ground-level borehole.

Another aspect of the present invention includes a portable pipe installation/removal support apparatus for mounting to a vehicle, comprising: a base adapted to be connected to a trailer hitch of the vehicle; an upright extending from the base; and a pair of catch arms extending from the upright, and defining a catch platform for releasably catching therebetween an underside of a pipe coupler connecting two pipe strings of a series of connectable pipe strings at an operator-convenient standing elevation, to allow the operator to stand upright while coupling/uncoupling the series of connectable pipe strings during the installation/removal thereof from a ground-level borehole.

A further aspect of the present invention includes a process for removing from a ground-level borehole a series of connected pipe strings, the process comprising: (a) positioning adjacent the ground-level borehole a portable pipe removal support apparatus having: a base, an upright extending from the base, and means connected to the upright for releasably holding an upper end of a pipe string at an operator-convenient standing elevation; (b) withdrawing from the ground-level borehole a first pipe string having a lower end coupled to an upper end of a second pipe string; (c) engaging the upper end of the second pipe string to the means for releasably holding an upper end of a pipe string at an operator-convenient standing elevation, whereby the second pipe string and one or more additional pipe strings therebelow are held by the support structure; (d) manually uncoupling and removing the first pipe string from the second pipe string; (e) releasing the second pipe string from the support apparatus; and (f) iteratively repeating steps (b) through (e) for one or more additional pipe strings in the ground-level borehole, whereby an operator may stand upright when manually uncoupling and removing pipe strings due to the position of each pipe connection at the operator-convenient standing elevation.

Still another aspect of the present invention includes a process for installing a series of connectable pipe strings into a ground-level borehole, the process comprising: (a) positioning adjacent the ground-level borehole a portable pipe installation support apparatus having: a base, an upright extending from the base, and means connected to the upright for releasably holding an upper end of a pipe string at an operator-convenient standing elevation; (b) partially lowering a first pipe string into the ground-level borehole; (c) engaging an upper end of the first pipe string to the means for releasably holding an upper end of a pipe string at an operator-convenient standing elevation, whereby the first pipe string and any pipe strings therebelow are held by the support structure; (d) suspending a second pipe string over the first pipe string; (e) manually coupling a lower end of the second pipe string to the upper end of the first pipe string; (f) releasing the first pipe string from the support apparatus; and (g) iteratively repeating steps (b) through (f) for one or more additional pipe strings to be installed in the ground-level borehole, whereby an operator may stand upright when manually coupling pipe strings due to the position of each pipe connection at the operator-convenient standing elevation.

BRIEF DESCRIPTION OF THE DRAWINGS

The accompanying drawings, which are incorporated into and form a part of the disclosure, are as follows.

DETAILED DESCRIPTION

Figure 2:
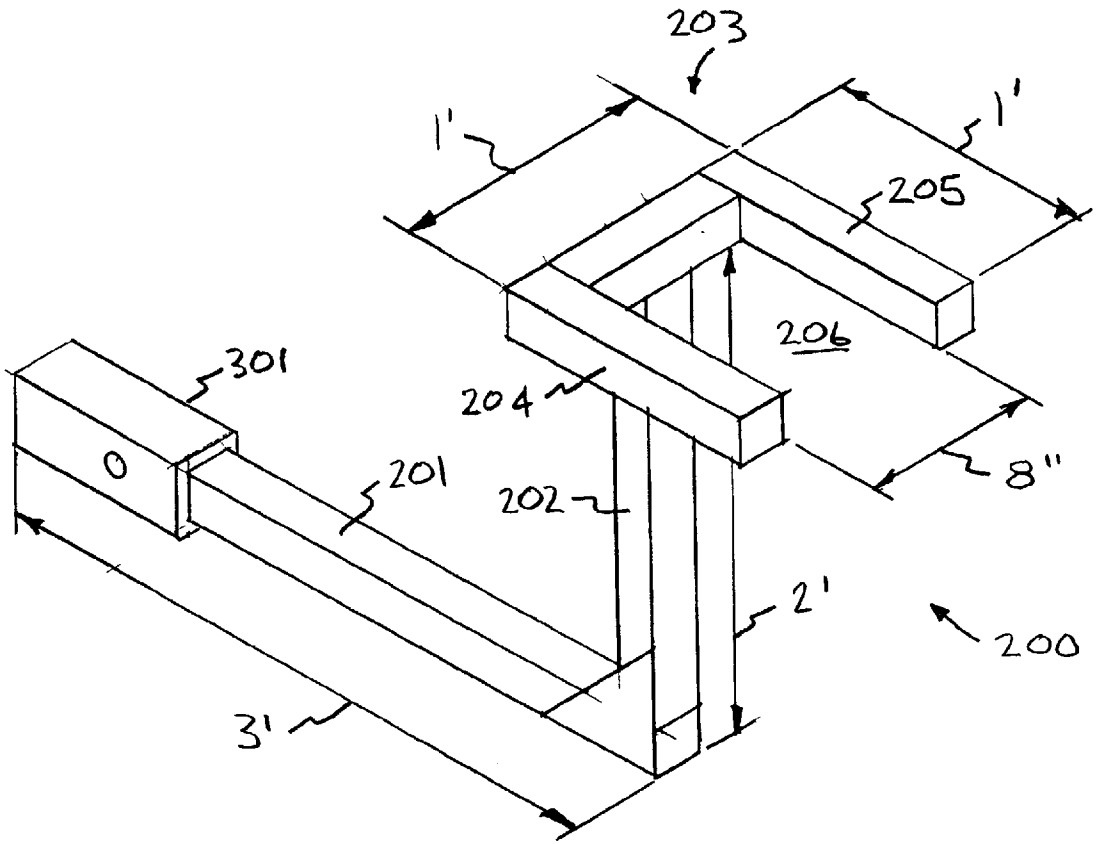
FIG. 2 is a perspective view of an exemplary portable pipe installation/removal support apparatus of the present invention.

Turning now to the drawings, FIG. 2 shows a perspective view of an exemplary portable pipe installation/removal support apparatus (hereinafter "support apparatus") of the present invention, generally indicated at reference character 200. The support apparatus 200 includes an elongated base 201, shown connected to a trailer hitch 301 of a vehicle (300 in FIG. 3), an upright portion 202 connected to the base 201, and a pair of catch arms 204, 205 connected to and extending from an upper end of the upright portion 202 in a generally U-shaped configuration, to form a horizontal catch plate or platform 203 with an open slot 206. The support apparatus 200 has a rigid construction, such as that made from steel or other similar high strength material or alloy capable of bearing heavy loads. In particular, the construction of the support apparatus 200 is suitably configured for use in groundwater well testing or servicing applications, i.e. capable of supporting a suspension load exerted by a suspended series of pipe strings extending the entire depth of a well. It is notable that common types of pipe strings used for these types of applications include ¾ inch diameter, sch80 PVC pipes, typically having a dry weight of 72.5 lbs per 100 feet. Alternative pipe types may include sch40, steel, black iron pipes, etc.) Since well depths can reach up to 200 feet, the pipe weight alone can reach up to about 150 lbs. For retrieving pumps already in use, the weight of water remaining in the pipes must also be considered, which can exceed 2000 lbs (for 34 inch diameter pipes).

Figure 3:
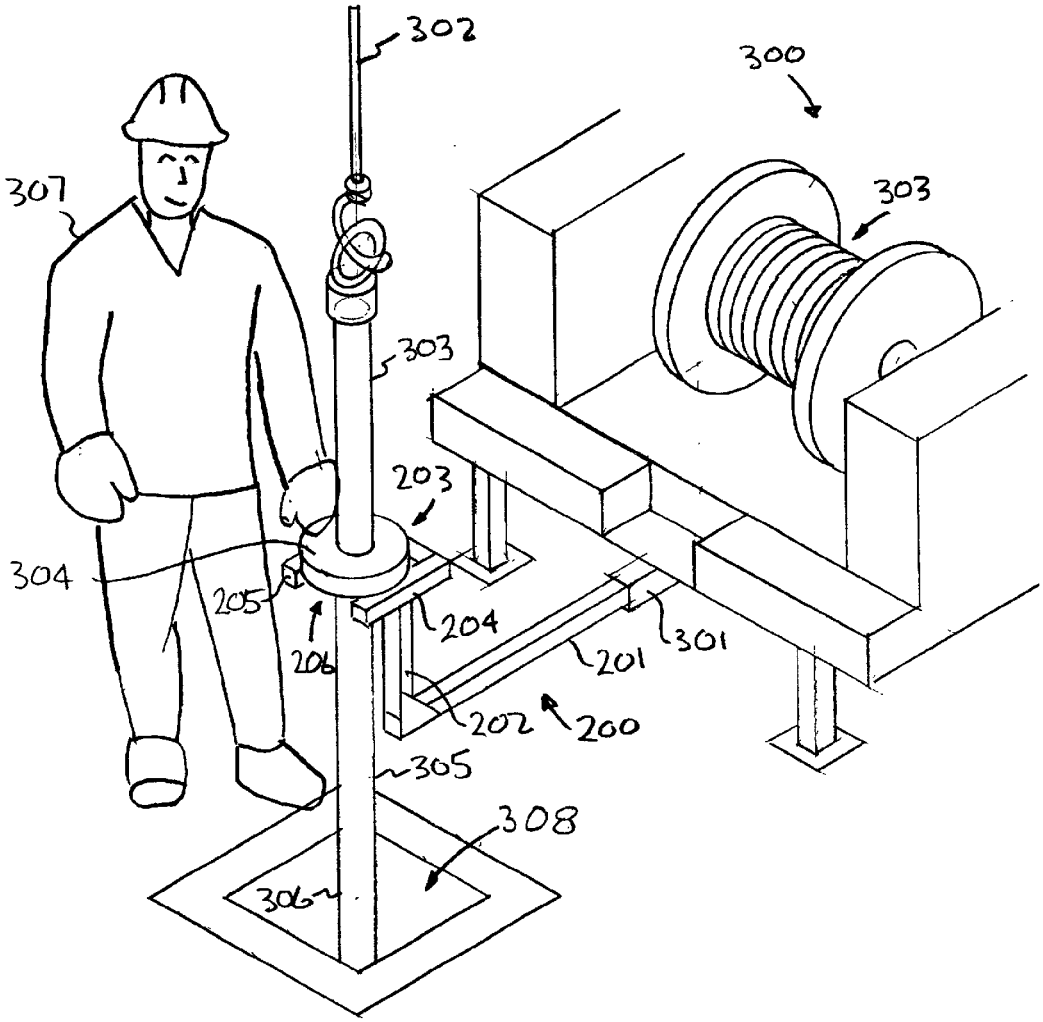
FIG. 3 is a perspective view of the exemplary portable pipe installation/removal support apparatus of FIG. 2 in operation.

As can be seen in FIGS. 2 and 3, the open slot 206 of the catch platform 203 is suitably wide for receiving a pipe string 306, but does not allow passage of a pipe coupler 304 used to connect the ends of two pipe strings. This catch engagement between the catch platform 203 and the pipe coupler 304 at an upper end of a pipe string, serves to support the entire weight of one or more of a series of connected pipe strings when installing/retrieving pipe strings from a well borehole 306, as shown in FIG. 3. Furthermore, as shown in FIG. 3, the base 201 and the upright portion 202 of the support apparatus 200 together serve to raise the elevation of the catch platform 203 (and the location of a pipe coupler) to a convenient standing elevation for an operator 307 to perform coupling/uncoupling tasks of the pipe strings. While the upright 202 is shown in the drawings as a solid non-adjustable length, it is appreciated that an adjustment mechanism (e.g. a telescoping configuration secured with a set screw) may also be used to achieve a desired elevation. The operator 307 is shown standing adjacent the catch platform 203 which is located at about the operator's waist level. It is appreciated that an "operator-convenient" standing elevation of the catch platform 203 suggests that the actual elevation of the catch platform 203 may vary as per a suitable convenience range for any one individual. Generally, however, an "operator-convenient standing elevation" is that elevation between about waist-level, to about shoulder-level (between about 3.5 feet to about 5.5 feet) of an operator standing next to the support apparatus, and the convenience is due in part to the substantial avoidance of repetitive bending, kneeling, or stooping motions.

Operation of the support apparatus 200 for installing/removing a series of connected pipe strings from a ground-level borehole, such as 306 shown in FIG. 3, begins by positioning the support apparatus sufficiently adjacent the borehole with the catch platform 203 directly above the borehole. This may involve simply backing the carrier vehicle 300 of the support apparatus towards the borehole, where the support apparatus (i.e. base) is mounted on the trailer hitch of the carrier vehicle. Or in the alternative, other exemplary embodiments may be utilized, such as for example, a support apparatus configured as a detachable or independent unit from the carrier vehicle, for operational placement on the ground adjacent the borehole. In this case, the base is configured and adapted to independently stand on the ground adjacent the ground-level borehole. In either case, the catch platform is located at the operator-convenient standing elevation discussed above and ready to engage and releasably hold a pipe string.

Figure 1:
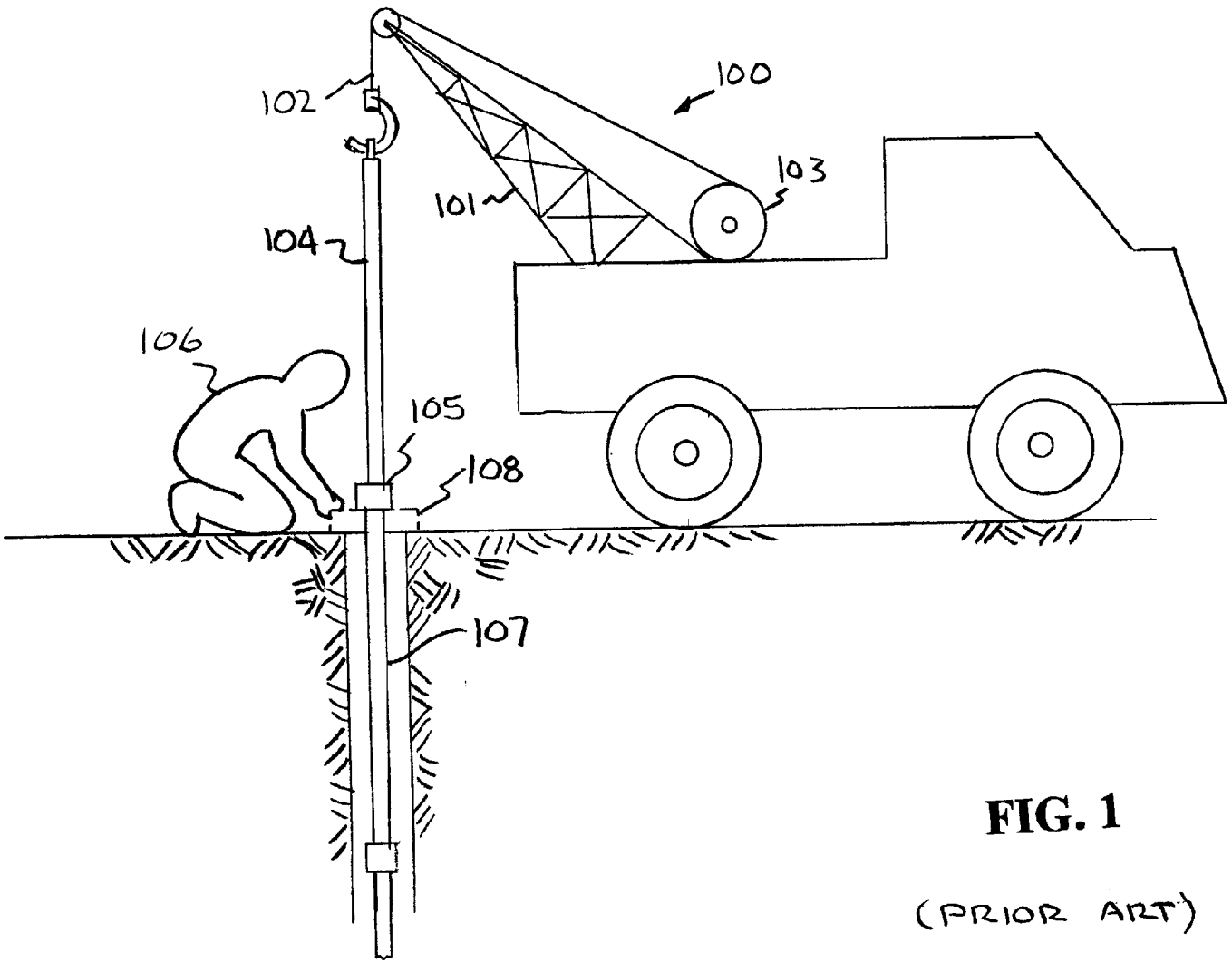
FIG. 1 (PRIOR ART)
FIG. 1 is a schematic view of a conventional method of retrieving pipe strings of a well pump practiced in the prior art.

Subsequent steps following the positioning of the support apparatus depend on whether the process is used for removing a series of pipe strings from the borehole, or for installing a series for pipe strings into the borehole.

Where the process is for removing a series of connected pipes from a ground-level borehole, a first pipe string (not shown) located at the top of the vertical series of connected pipe strings, is withdrawn from the borehole using a derrick rig arrangement partially shown in FIG. 3 having a winch 303, a winch cable 302, and a crane (not shown). It is appreciated that the load supported by the support apparatus 200 in withdrawing the first pipe string includes all other connected pipe strings following behind the first pipe string, with the lower end of the first pipe string connected to the upper end of a second pipe string. The connection between the first and second pipe strings (and any two consecutive pipe strings) is typically realized with a pipe coupler, such as 105 shown in the prior art of FIG. 1, as well as 304 shown in FIG. 3.

In any case, and as shown in FIG. 3, the pair of catch arms 204, 205 of the catch platform 203 are then engaged with the upper end 305 of the second pipe string 306 adjacently below the pipe coupler 304. This is accomplished by straddling the second pipe string 306 between the catch arms 204, 205, and subsequently lowering the second pipe string 306 to rest an underside of the pipe coupler 304 on top of the catch arms 204, 205. In this manner, the series of connected pipe strings, not including the first pipe string, is fully supported and held by the pipe coupler connected to the upper end of the second pipe string. Thus the first pipe string may now be manually uncoupled and removed from the second pipe string by the operator 307 at the operator-convenient standing elevation. Once uncoupled, the first pipe string is lifted away and removed using the derrick rig setup 3.

After removal of the first pipe string, an adaptive connector such as 303 in FIG. 3, may be reconnected to the pipe coupler located at the upper end 305 of the second pipe string 306 in preparation for removal of the second pipe string from a connected third pipe string (not shown). The adaptive connector 303 has a reduced length and a top end hooked to the winch cable 302 and a lower end connectable to a pipe coupler, such as 304. Similar to the uncoupling task, the reconnection is also accomplished manually by the operator at the operator-convenient standing elevation without having to bend down over the borehole. In any event, and after the reconnection, the second pipe string is then released from the catch platform 203 and the support apparatus, such that it too may be withdrawn from the borehole and the aforementioned steps iteratively repeated for every pipe string of the series of connected pipe strings in the ground-level borehole.

Where the process is for installing a series of connectable pipes into a ground-level borehole, a similar but reverse procedure of the removal process is employed. Initially, a first pipe having a pipe coupler connected to an upper end thereof, is partially lowered into the borehole using the derrick rig setup discussed previously. Next, the upper end of the first pipe string is engaged/straddled between the pair of catch arms adjacently below the pipe coupler, such that an underside of the pipe coupler rests on the catch arms. In this manner, the first pipe string is fully supported and held by the support apparatus via the pipe coupler connected to the upper end of the first pipe string.

Next, a second pipe string, having a pipe coupler at an upper end thereof, is suspended over the first pipe string. The operator then manually couples a lower end of the second pipe string to the upper end of the first pipe string, i.e. at the pipe coupler at the upper end of the first pipe string. Again, due to the elevating function of the support apparatus, the coupling joint is positioned at an operator-convenient standing elevation for facilitating operator tasks. Once manually coupled by the operator, the first pipe string is released from the support apparatus, and the now-connected first and second pipe strings, is lowered into the borehole. These steps are iteratively repeated for every pipe string to be installed in series in the borehole. Thus, for example, a third pipe string may be coupled to the upper end of the second pipe string which remains held by the pair of catch arms on the catch platform.

Figure 4:
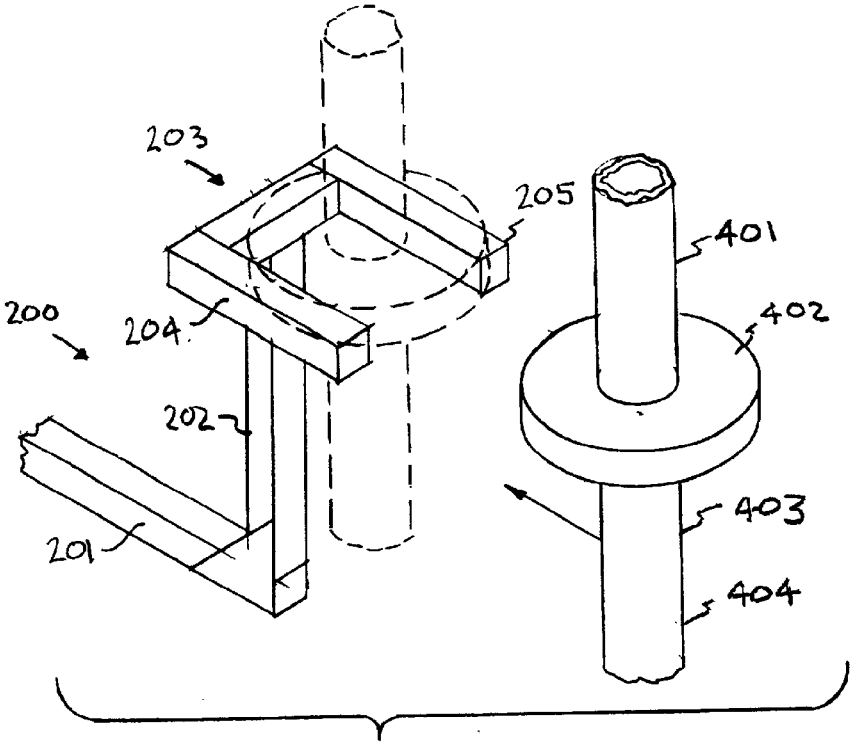
FIG. 4 is a side perspective view of a first exemplary method of engaging the pair of catch arms with a pipe string.
Figure 5:
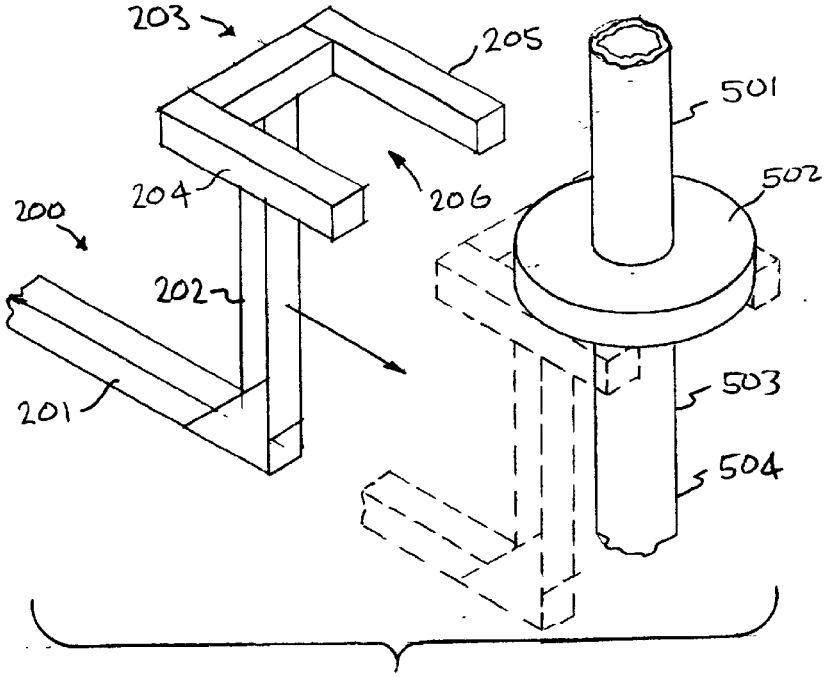
FIG. 5 is a side perspective view of a second exemplary method of engaging the pair of catch arms with a pipe string.

FIGS. 4 and 5 show two exemplary methods of engaging the catch platform 203 with the upper end of a pipe string adjacently below a pipe coupler. In both of these methods, the support apparatus has a base which is configured and adapted to be movably connected to a trailer hitch of a carrier vehicle for extending and retracting the support apparatus from the vehicle. As shown in FIG. 3, the movable connection may be achieved by using a telescoping cantilevered arrangement by which the support apparatus may be extended/retracted while still capable of bearing heavy suspension loads at the catch plate end. In FIG. 4, the support apparatus 200 is held stationary, such as by parking the carrier vehicle sufficiently over the borehole. Next, and before the pipe coupler is lowered to rest on the catch plate 203, the pipe strings 401, 404 and the pipe coupler 402 are moved laterally into and between the catch arms 204, 205. Once seated in the slot, the pipe strings may be lowered to bring the pipe coupler in seating contact with the catch plate. And in FIG. 5, the pipe strings 501 and 504 are held stationary, and the support apparatus 200 is extended/retracted from the vehicle in a lateral direction to straddle/release the upper end 503 of the lower pipe string.

In both of the aforementioned installation and removal operations, the operator is capable of performing coupling/uncoupling and reconnection tasks while in a standing position, without having to bend over, stoop down, or otherwise lower him/herself to an inconvenient and stress/strain inducing position. It is thus estimated that the use of the present invention effectively reduces repetitive motion from twenty to thirty bending actions to two to three with the same gained result. This is a fifteen to twenty-fold improvement over the conventional method described in the background. While the potential for serious and long-lasting back injuries is extraordinarily high for the conventional method, the support apparatus of the present invention serves to make pipe installing and removal for such applications as deploying well pumps, easier and safer. Additionally, while well pump retrieval and deployment has always been a two person operation, a single operator is now capable of completing the job alone and far more efficiently. This translates to a savings of approximately 200–250 man-hours, along with savings in associated labor costs.

While a generally U-shaped catch platform has been discussed herein, the present invention is not limited only to such. Other structures and or mechanisms, such as mechanical spiders, may be employed which are connected to the upper end of the upright and function to releasably hold an upper end of a pipe string at an operator-convenient standing elevation. The holding function may be effected by catching, grasping, locking or other releasable means for acting upon a pipe string to prevent it from falling into the well.

And while particular operational sequences, materials, temperatures, parameters, and particular embodiments have been described and or illustrated, such are not intended to be limiting. Modifications and changes may become apparent to those skilled in the art, and it is intended that the invention be limited only by the scope of the appended claims.

What is claimed is:

1. A portable pipe installation/removal support apparatus comprising:

a base;

an upright extending from the base; and means connected to the upright for releasably holding an upper connector end of a pipe string at an operator-convenient standing elevation to allow the operator to stand upright while coupling/uncoupling a series of connectable pipe strings during the installation/removal thereof from a ground-level borehole, wherein said means for releasably holding an upper connector end of a pipe string at an operator-convenient standing elevation is a pair of catch arms extending from the upright and defining a catch platform for releasably catching therebetween an underside of a pipe coupler connecting two pipe strings of the series of connectable pipe strings.

2. A portable pipe installation/removal support apparatus comprising:

a base;

an upright extending from the base; and means connected to the upright for releasably holding an upper connector end of a pipe string at an operator-convenient standing elevation to allow the operator to stand upright while coupling/uncoupling a series of connectable pipe strings during the installation/removal thereof from a ground-level borehole, wherein said base is adapted to be connected to a trailer hitch of a vehicle.

3. The portable pipe installation/removal support apparatus as in claim 2, wherein said base is adapted to be cantilevered from the trailer hitch.

4. The portable pipe installation/removal support apparatus as in claim 2, wherein said base is adapted to be movably connected to the trailer hitch for extending/retracting the support apparatus from the vehicle to catch/release, respectively, a pipe string via the means for releasably holding a pipe string.

5. A portable pipe installation/removal support apparatus for mounting to a vehicle, comprising:

a base adapted to be connected to a trailer hitch of the vehicle;

an upright extending from the base; and a pair of catch arms extending from the upright, and defining a catch platform for releasably catching therebetween an underside of a pipe coupler connecting two pipe strings of a series of connectable pipe strings at an operator-convenient standing elevation, to allow the operator to stand upright while coupling/uncoupling the series of connectable pipe strings during the installation/removal thereof from a ground-level borehole.

6. The portable pipe installation/removal support apparatus as in claim 5, wherein said base is adapted to be cantilevered from the trailer hitch.

7. The portable pipe installation/removal support apparatus as in claim 5, wherein said base is adapted to be movably connected to the trailer hitch for extending/retracting the support apparatus from the vehicle to catch/release, respectively, a pipe string via the means for releasably holding a pipe string.

8. A process for removing from a ground-level borehole a series of connected pipe strings, the process comprising:

(a) positioning adjacent the ground-level borehole a portable pipe removal support apparatus having: a base, an upright extending from the base, and means connected to the upright for releasably holding an upper end of a pipe string at an operator-convenient standing elevation;

(b) withdrawing from the ground-level borehole a first pipe string having a lower end coupled to an upper end of a second pipe string;

(c) engaging the upper end of the second pipe string to the means for releasably holding an upper end of a pipe string at an operator-convenient standing elevation, whereby the second pipe string and all pipe strings therebelow are held by the support structure;

(d) manually uncoupling and removing the first pipe string from the second pipe string;

(e) releasing the second pipe string from the support apparatus; and (f) iteratively repeating steps (b) through (e) for one or more pipe strings in the ground-level borehole, whereby an operator may stand upright when manually uncoupling and removing pipe strings due to the position of each pipe connection at the operator-convenient standing elevation.

9. The process as in claim 8, wherein said means for releasably holding an upper end of a pipe string at an operator-convenient standing elevation is a pair of catch arms extending from the upright and defining a catch platform; and wherein said engagement step includes catching the underside of a pipe coupler of the upper end of the second pipe string between and with the pair of catch arms, whereby the second pipe string and all pipe strings therebelow are held by the support structure via the pipe coupler.

10. The process as in claim 9, wherein said base is adapted to be movably connected to the trailer hitch for extending/retracting the support apparatus from the vehicle;

wherein the step of catching the underside of the pipe coupler between and with the pair of catch arms comprises extending the support apparatus from the vehicle to straddle the second pipe string between the pair of catch arms adjacently below the pipe coupler, and lowering the second pipe string to rest the underside of the pipe coupler on the catch arms; and wherein the step of releasing the second pipe string comprises raising the pipe coupler off the catch arms and retracting the support apparatus back to the vehicle.

11. The process as in claim 9, wherein the step of catching the underside of the pipe coupler between and with the pair of catch arms comprises moving the second pipe string in between the pair of catch arms and lowering the second pipe string to rest the underside of the pipe coupler on the catch arms; and wherein the step of releasing the second pipe string comprises raising the pipe coupler off the catch arms and moving the second pipe string out from between the catch arms.

12. A process for installing a series of connectable pipe strings into a ground-level borehole, the process comprising:

(a) positioning adjacent the ground-level borehole a portable pipe installation support apparatus having: a base, an upright extending from the base, and means connected to the upright for releasably holding an upper end of a pipe string at an operator-convenient standing elevation;

(b) partially lowering a first pipe string into the ground-level borehole;

(c) engaging an upper end of the first pipe string to the means for releasably holding an upper end of a pipe string at an operator-convenient standing elevation, whereby the first pipe string and any pipe strings therebelow are held by the support structure;

(d) suspending a second pipe string over the first pipe string;

(e) manually coupling a lower end of the second pipe string to the upper end of the first pipe string;

(f) releasing the first pipe string from the support apparatus; and (g) iteratively repeating steps (b) through (f) for one or more pipe strings to be installed in the ground-level borehole, whereby an operator may stand upright when manually coupling pipe strings due to the position of each pipe connection at the operator-convenient standing elevation, wherein said means for releasably holding an upper end of a pipe string at an operator-convenient standing elevation is a pair of catch arms extending from the upright and defining a catch platform; and wherein said engagement step includes catching the underside of a pipe coupler of the upper end of the first pipe string between and with the pair of catch arms, whereby the first pipe string and all pipe strings therebelow are held by the support structure via the pipe coupler.

13. The process as in claim 12, wherein said base is adapted to be movably connected to the trailer hitch for extending/retracting the support apparatus from the vehicle;

wherein the step of catching the underside of the pipe coupler between and with the pair of catch arms comprises extending the support apparatus from the vehicle to straddle the first pipe string between the pair of catch arms adjacently below the pipe coupler, and lowering the first pipe string to rest the underside of the pipe coupler on the catch arms; and wherein the step of releasing the first pipe string comprises raising the pipe coupler off the catch arms and retracting the support apparatus back to the vehicle.

14. The process as in claim 12, wherein the step of catching the underside of the pipe coupler between and with the pair of catch arms comprises moving the first pipe string in between the pair of catch arms and lowering the first pipe string to rest the underside of the pipe coupler on the catch arms; and wherein the step of releasing the first second pipe string comprises raising the pipe coupler off the catch arms and moving the first pipe string out from between the catch arms.

* * * * *